United States Patent [19]

Ranghelli et al.

[11] Patent Number: 4,916,414

[45] Date of Patent: Apr. 10, 1990

[54] PERMANENT MAGNET CIRCULATOR HAVING U-SHAPED FERRITES AND MAGNETS

[75] Inventors: Joseph Ranghelli; John P. Pehowich, both of Brooklyn; Gerald C. Dorman, Lindenhurst, all of N.Y.

[73] Assignee: Raytheon COmpany, Lexington, Mass.

[21] Appl. No.: 358,225

[22] Filed: May 30, 1989

[51] Int. Cl.[4] ..... H01P 1/397

[52] U.S. Cl. ..... 333/1.1; 333/24.2; 333/24.1

[58] Field of Search ..... 333/1.1, 122, 24.1, 333/24.2

[56] References Cited

U.S. PATENT DOCUMENTS 2,866,949 12/1958 Tillotson ..... 333/1.1
3,036,278 5/1962 Chait et al. ..... 333/1.1
3,187,274 6/1965 Owen et al. ..... 333/1.1
4,039,975 8/1977 Debski ..... 333/122

OTHER PUBLICATIONS

Author Merrill I. Skolnik, *Radar Handbook,* McGraw-Hill, Inc, 1970, pp. 8-23.

*Primary Examiner*—Paul Gensler
*Attorney, Agent, or Firm*—Richard M. Sharkansky; Philip J. McFarland

[57] ABSTRACT

A circulator for duplexing microwave signals is shown to consist of a pair of folded magic-T hybrid junctions with a nonreciprocal phase shift section disposed between the parallel ports of such junctions, the nonreciprocal phase shift section being made up of U-shaped ferrites supported between the insides of H-plane walls in a rectangular waveguide and U-shaped permanent magnets adjustably supported on the outsides of the H-plane walls so that the magnetic flux in the U-shaped ferrites may be changed as required.

7 Claims, 2 Drawing Sheets

PERMANENT MAGNET CIRCULATOR HAVING U-SHAPED FERRITES AND MAGNETS

BACKGROUND OF THE INVENTION

This invention pertains generally to electrical transmission lines, and particularly to circulators and phase shifters adapted to control microwave signals in such lines.

It is known in the art that magnetic ceramic materials, usually referred to as "ferrites," may be used to form different types of elements that control the phase shift of a microwave signal in an electrical transmission line, such as a waveguide. Thus, it is known that a single antenna may be used for transmitting and receiving by: (a) connecting a transmitter through a first transmission line to the H-plane port of a first folded magic-T hybrid junction; (b) connecting a receiver through a second transmission line to the E-plane port of such junction; and (c) connecting the antenna, via a second folded magic-T hybrid junction and third and fourth transmission lines, to the parallel ports of the first folded magic-T hybrid junction. Properly designed and actuated ferrites disposed within the third and fourth transmission lines provide nonreciprocal phase shifts to microwave signals to cause such signals to be directed (when transmitting) from the transmitter to the antenna and to be directed (when receiving) from the antenna to the receiver.

Several problems are encountered in making and operating a circulator such as that just described. For example, proper actuation of a ferrite requires precise control of the strength and direction of a magnetic field interacting with the ferrite. Therefore, although permanent magnets may be used to provide the requisite magnetic field for a ferrite, it has been found to be very difficult to control both the strength and direction of such a magnetic field with a permanent magnet.

Another problem encountered in the fabrication of any known type of circulator derives from the fact that it is relatively easy to induce unwanted modes of propagation within a waveguide. To avoid unwanted modes of propagation (which may cause excessively large insertion losses) extreme care must be taken in design and construction.

SUMMARY OF THE INVENTION

With the foregoing background of this invention in mind, it is a primary object of this invention to provide a circulator using permanent magnets to provide required magnetic fields for a ferrite.

Another object of this invention is to provide a circulator in which a magnetic field may be mechanically adjusted as required.

Still another object of this invention is to provide an improved phase shifter.

A still further object of this invention is to provide a ferrite phase shifter that is relatively immune to adverse effects of higher modes of propagation.

The foregoing and other objects of this invention are generally attained by the combination of (a) two rectangular waveguides connecting the parallel parts of a pair of folded magic-T hybrid junctions, each such waveguide having at least one nonmagnetic wall and an opposing wall; (b) a ferrite element disposed within each one of the two rectangular waveguides so as to contact the inner surfaces of the at least one nonmagnetic wall and the opposing wall in each such waveguide; and (c) a permanent magnet movably mounted on the outer surface of the nonmagnetic wall in each rectangular waveguide in an adjustable overlapping relationship with the ferrite element, the cross-sectional shapes of the ferrite element and the permanent magnet being generally U-shaped whereby magnetic flux is directed from the permanent magnet through the overlapping portion of the ferrite element so that the nonreciprocal phase shift imparted to microwave signals within each rectangular waveguide may be controlled by changing the degree of overlapping. In addition, in one embodiment a nonmagnetic material having a dielectric constant approximating that of the ferrite element fills the space between the arms of the ferrite element. In another embodiment a thin graphite rod is centrally disposed within the nonmagnetic material When the contemplated assembly is to be used as a circulator, the H-plane port of a first one of the folded magic-T hybrid junctions is connected to a transmitter and the E-plane port of such junction is connected to a receiver, while the H-plane port of the second one of the folded magic-T hybrid junctions is connected to an antenna and the E-plane port of such junction is terminated in a characteristic impedance. When use as a phase shifter (or isolator) is contemplated, the E-plane ports of both folded magic-T hybrid junctions are temrinated in characteristic impedances, while a source of microwave signals is connected to the H-plane port of one folded magic-T hybrid junction and a utilization device is connected to the H-plane port of the other folded magic-T hybrid junction.

BRIEF DESCRIPTION OF THE DRAWINGS

For a more complete understanding of this invention, reference is now made to the following description of the accompanying drawings, wherein.

DESCRIPTION OF THE PREFERRED EMBODIMENT

Figure 1:
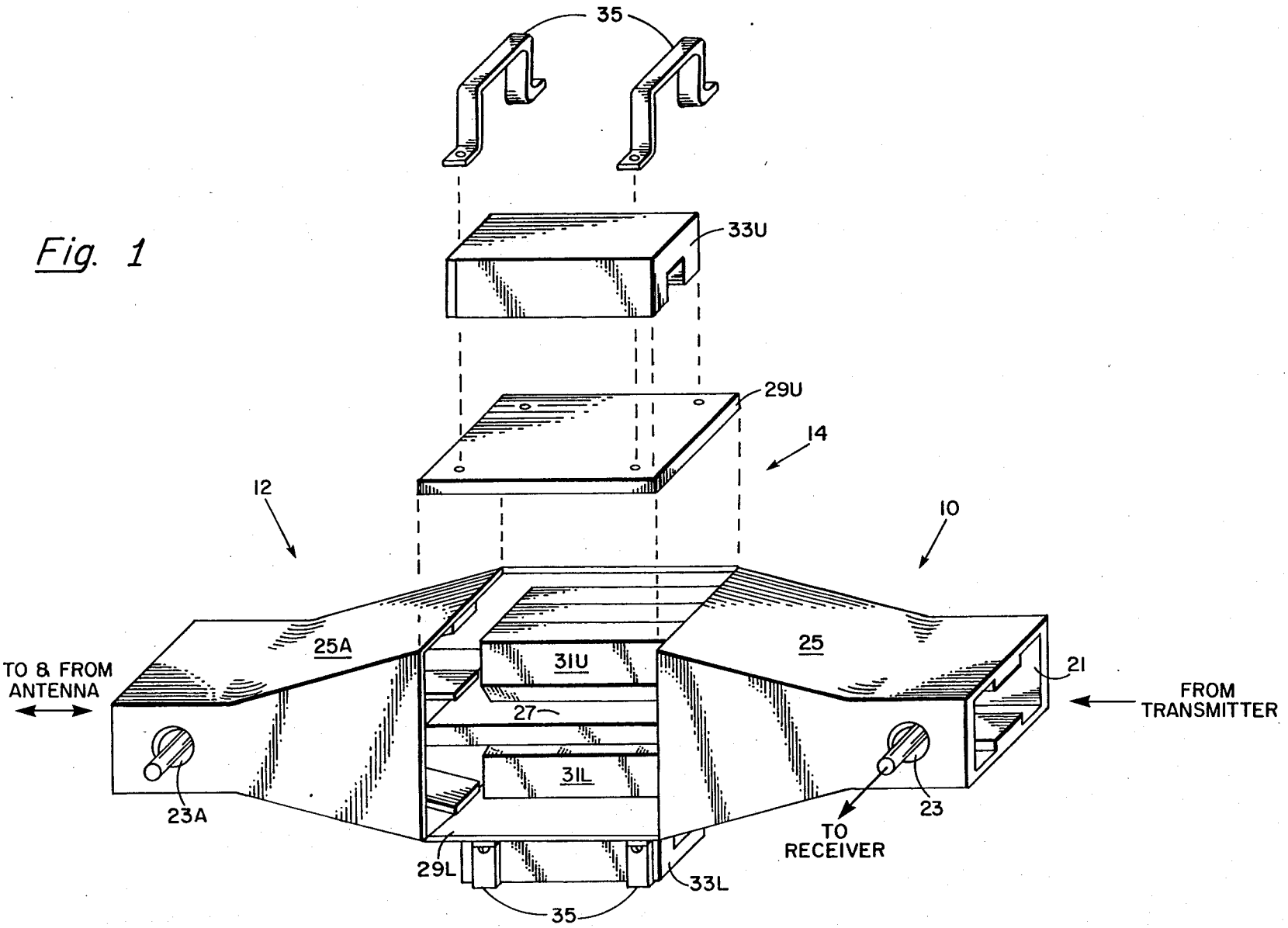
FIG. 1 is a view, partially exploded and cut away the better to illustrate a preferred embodiment of the invention, of a circulator incorporating our inventive concepts.

Before referring to the drawings in detail, it should be noted that the preferred embodiment utilizes double ridge waveguide as the transmission medium in which the contemplated circulator is formed. It will be recognized therefore that the hybrids such as the hybrid illustrated and claimed in U.S. Pat. No. 4,039,975, issued Aug. 2, 1977, entitled "E-Plane Folded Hybrid With Coaxial Difference Port," (which patent is assigned to the same assignee as this application and is incorporated herein by reference) may be used to advantage here.

With the foregoing in mind, it may be seen that a preferred embodiment of this invention comprises a first folded magic-T hybrid junction 10, a second folded magic-T hybrid junction 12 and a nonreciprocal phase shift section 14.

The first folded magic-T hybrid junction 10 here preferably is made in accordance with the teaching of U.S. Pat. No. 4,039,975, cited. Thus, a microwave signal from a transmitter (not shown) is introduced in any convenient manner to an input port, i.e., the H-plane port 21 of the first folded magic-T hybrid 10. That hybrid further includes a pair of parallel arms (not shown) and an output port, i.e., the E-plane port 23. As is shown in U.S. Pat. No. 4,039,975, cited, each one of the pair of parallel arms (not shown) is a section of double ridge waveguide having a common H-plane wall 27 within the section indicated by the numeral 25 and that the pair of parallel arms is terminated in a pair of colinear ports (not shown) adjacent to the nonreciprocal phase shift section 14. The common H-plane wall 27 further is shaped to form a "ridge waveguide-to-coaxial" coupler for the E-plane port 23. It will now be appreciated that, as explained in detail in U.S. Pat. No. 4,039,975, any microwave signal applied to the input port 21 is divided into two equal in-phase signals at the pair of colinear ports and no appreciable portion of any microwave signal is coupled directly from the input port 21 to the E-plane port 23.

Microwave signals at the colinear ports of the first folded magic-T hybrid junction 10 are passed through the nonreciprocal phase shift section 14. The just-mentioned section is here made up of a first run of waveguide (not numbered) and a second run of waveguide (not numbered) separated by the common H-plane wall 27, disposed as shown between the first and second folded magic-T hybrid junctions 10, 12. The second H-plane wall 29U of the first run of waveguide (not numbered) and the second H-plane wall 29L of the second run of waveguide (not numbered) are fabricated from an electrically conductive, but nonmagnetic, material, such as a sheet of aluminum. Such second H-plane walls 29U, 29L are attached to the E-plane walls (not numbered) of the nonreciprocal phase shift section 14 in any convenient manner. A ferrite member 31U is disposed, as shown, between the upper surface of the common H-plane wall 27 and the lower (or inner) surface of the second H-plane wall 29U. A ferrite member 31L is disposed, as shown, between the lower surface of the common H-plane wall 27 and the upper (or inner) surface of the second H-plane wall 29L. Any conventional method of affixing the ferrite members 31U, 31L may be used. A permanent magnet 33U is disposed on the upper (or outer) surface of the second H-plane wall 29U. A permanent magnet 33L is disposed on the lower (or outer) surface of the second H-plane wall 29L. Each permanent magnet 33U, 33L initially is movable longitudinally of the nonreciprocal phase shift section 14 so as to adjust the overlap between each such magnet and the associated ferrite member 31U or 31L. After adjustment, the position of each permanent magnet 33U, 33L is maintained by straps 35 affixed in any convenient way to the nonreciprocal phase shift section 14.

Figure 2:
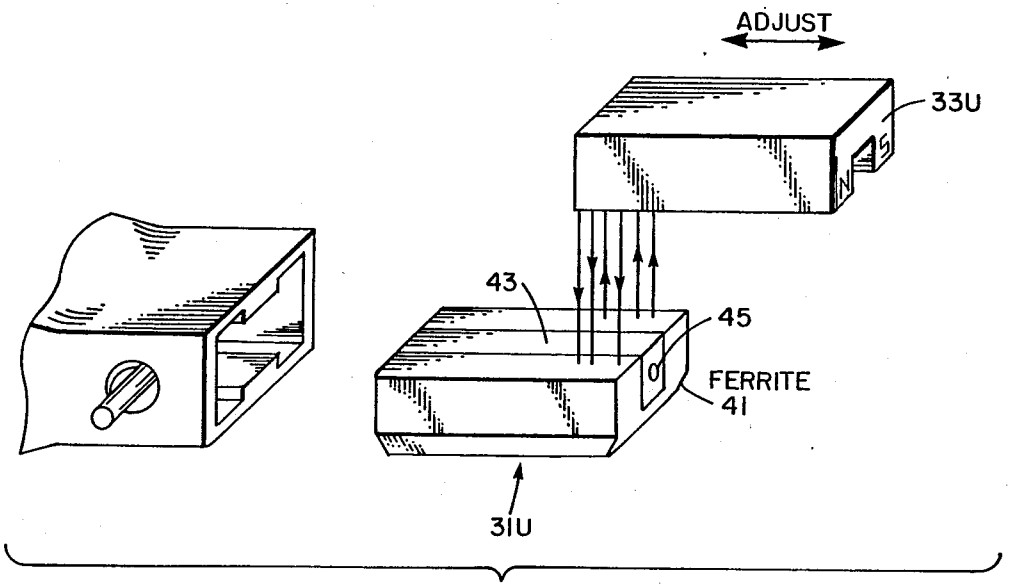
FIG. 2 is an isolated view of a ferrite element and a permanent magnet as used in the circulator of FIG. 1.

Referring now to FIG. 2, it may be seen that each one of an exemplary ferrite member (here ferrite member 31U) and of an exemplary one of the permanent magnets (here permanent magnet 33U) is substantially U-shaped in cross-section. Thus, ferrite element 31U here is made up of a sintered ferrite 41 having a cross-section that is U-shaped and filled with a dielectric material 43 that here supports a thin rod 45 centrally of the sintered ferrite 41. Although the composition of the various parts of the ferrite element 31U may be varied, it is here preferred that the material of the sintered ferrite be a magnesium-manganese ferrite type TT 105 by TRANS TECH, INC., Adamstown, MD, of the dielectric material be a ceramic dielectric designated "SMAT" by the just-designated company and of the thin rod 45 be carbon or graphite. With the just-recited materials it has been found that insertion loss is minimized and unwanted modes of propagation within the nonreciprocal phase shift section 14 (FIG. 1) are suppressed. The permanent magnet 33U may be fabricated from any known material and magnetized so that the magnetic poles N, S are as indicated. As shown in FIG. 2 by the double-headed arrow labeled "ADJUST," the overlay of the permanent magnet 33U with respect to the ferrite element 31U may be changed to adjust the total magnetic flux (as indicated by the flux lines (not numbered) linking such magnet and element.

Referring back to FIG. 1, the second folded magic-T hybrid junction 12 is seen to be identical with the first folded magic-T hybrid junction 10. Thus, the common H-plane wall 27 is extended through the section 25A, being shaped to form a ridge waveguide-to-coaxial coupler for an E-plane port 23A. Such port is, when a circulator is desired, terminated by a characteristic impedance (not shown). The H-plane port (not shown) of the second folded magic-T hybrid junction 12 is here connected in any convenient manner to an antenna (not shown).

In order that the just-described assembly operate as a circulator, it is necessary that there be a difference between the phase shift imparted to microwave signals passing through the nonreciprocal PHASE shift section 14 from the first folded magic-T hybrid junction 10 and the phase shift imparted on microwave signals passing through such section from the second folded magic-T hybrid junction 12. The position of each one of the permanent magnets 33U, 33L may be adjusted to provide a proper difference in phase shifts in the nonreciprocal phase shift. Thus, if a microwave signal is applied to the H-plane port of the second folded magic-T hybrid junction 12 and the level of the microwave signals appearing at the H-plane port 21 and the E-plane port 23 of the first folded magic-T hybrid junction 10 are observed in any known manner, then the positions of the permanent magnets 33U, 33L may be adjusted until the level of the microwave signal at the E-plane port 23 is a maximum and the level of such signal at the H-plane port 21 is a minimum. When such maximum and minimum occur a microwave signal from a transmitter (not shown) is directed to the H-plane port of the second folded magic-T hybrid junction 12, i.e., a microwave signal to be transmitted is directed to an antenna (not shown), and (b) received microwave signals passing from an antenna (not shown) through the second folded magic-T hybrid junction 12 and the phase shift section 14 of the first folded magic-T hybrid junction 10 appears only at the E-plane port 23 of the first folded magic-T hybrid junction 10.

Having described a preferred embodiment of this invention, it will be apparent to one of skill in the art that many changes may be incorporated without departing from our inventive concepts. For example, the thin rod 45 may sometimes be eliminated, impedance transformers may be incorporated in the folded magic-T hybrid junctions to avoid mismatches, or, if a phase shifter (or isolator) is desired, the E-plane port of the first folded magic-T hybrid junction 10 could be terminated in a characteristic impedance.

In view of the foregoing it is felt that this invention should not be restricted to the disclosed embodiment, but rather should be limited only by the spirit and scope of the appended claims.

What is claimed is:

1. In a microwave transmission line assembly wherein a pair of folded magic-T hybrid junctions, each having an H-plane port, an E-plane port and a pair of parallel ports, and a pair of nonreciprocal phase shifters incorporated in two runs of waveguide interconnecting the parallel ports in such junctions, with each one of such runs having a common H-plane wall and a nonmagnetic H-plane wall, are combined to direct microwave signals entering the H-plane port of a first one of such junctions to the H-plane port of a second one of such junctions and to direct microwave signals entering the H-plane port of the second one of such junctions to the E-plane port of the first one of such junctions, the improvement comprising:

(a) a first nonreciprocal ferrite phase shifter disposed within a first one of the two runs of waveguide and a second nonreciprocal ferrite phase shifter disposed within the second run of waveguide, each of such phase shifters having a substantially U-shaped cross-section, with the open ends of each of such phase shifters in contact with the inner surface of the nonmagnetic H-plane wall of a corresponding one of the runs of waveguide;

(b) a first and a second permanent magnet, each disposed on the outer surface of a corresponding nonmagnetic H-plane wall and having a substantially U-shaped cross-section corresponding to the U-shaped cross-section of the corresponding nonreciprocal ferrite phase shifter, whereby magnetic flux from each permanent magnet may be linked, through the nonmagnetic H-plane wall, to the portion of the corresponding nonreciprocal ferrite phase shifter underlying each permanent magnet; and (c) means for changing the position of each permanent magnet along the corresponding nonmagnetic H-plane wall to adjust the length of the underlying portion of the corresponding nonreciprocal ferrite phase shifter underlying each permanent magnet.

2. The improvement as in claim 1 wherein the space between the arms of the U-shaped cross-section of each nonreciprocal ferrite phase shifter is filled with a ceramic dielectric having substantially the same dielectric constant as the nonreciprocal ferrite phase shifter.

3. The improvement as in claim 2 wherein the nonreciprocal ferrite phase shifter is fabricated from a magnesium-manganese ferrite.

4. The improvement as in claim 3 having, additionally, a carbon rod disposed centrally of the ceramic dielectric.

5. The improvement as in claim 4 wherein each one of the folded magic-T hybrid junctions is fabricated of double-ridge rectangular waveguide with ridges on the H-plane walls of such waveguide.

6. The improvement as in claim 5 wherein the E-plane port of the second folded magic-T hybrid junction is terminated in a characteristic impedance, thereby to form a circulator.

7. The improvement as in claim 6 wherein, additionally, the E-plane port of the first folded magic-T hybrid junction is terminated in a characteristic impedance, thereby to form an isolator.

* * * * *